United States Patent [19]

Ingles

[11] Patent Number: 4,491,257

[45] Date of Patent: Jan. 1, 1985

[54] ATTACHABLE BASKET FOR INVALID SUPPORT EQUIPMENT

[76] Inventor: Wesley L. Ingles, Rte. 1, Box 306, Banks, Oreg. 97106

[21] Appl. No.: 501,182

[22] Filed: Jun. 6, 1983

[51] Int. Cl.[3] ..... A45B 3/00; A61H 3/00; A61H 3/02; A61H 3/04

[52] U.S. Cl. ..... 224/42.45 R; 135/66; 135/67; 135/68; 224/42; 224/42.46 R; 224/273; 280/289 WC; 297/188

[58] Field of Search ..... 224/42.45 R, 42.46 R, 224/39, 42, 30 R, 32 R, 273; 297/191, 188, 194, 153, 5; 135/66, 67, 68; 280/289 WC

[56] References Cited

U.S. PATENT DOCUMENTS

| | | | |
|---|---|---|---|
| 2,633,278 | 3/1953 | Muniz | 224/42.46 R |
| 2,745,465 | 5/1956 | Hogan | 135/67 X |
| 2,750,951 | 6/1956 | Barnwell | 135/66 X |
| 2,912,991 | 11/1959 | Shinn | 135/66 X |
| 3,338,628 | 8/1967 | Evans | 297/188 |
| 3,526,314 | 9/1970 | Trammell, Jr. | 297/191 X |
| 4,074,683 | 2/1978 | DiChiara | 135/67 |
| 4,140,192 | 2/1979 | Sharpe | 224/42.45 R X |
| 4,212,493 | 7/1980 | Ledesky | 135/67 X |
| 4,289,156 | 9/1981 | Ulies | 135/66 |

*Primary Examiner*—Allan N. Shoap
*Attorney, Agent, or Firm*—Glen A. Collett

[57] ABSTRACT

An article carrying receptacle attachable to an item of invalid support equipment such as a wheelchair, crutch or walker. The invalid support equipment mounts a bracket at a position away from the usual working surfaces of the item. A basket has a hook mounted thereon which is operable to overlap and releasably engage the bracket to support the basket at the convenience of the user.

7 Claims, 4 Drawing Figures

FIG. 1
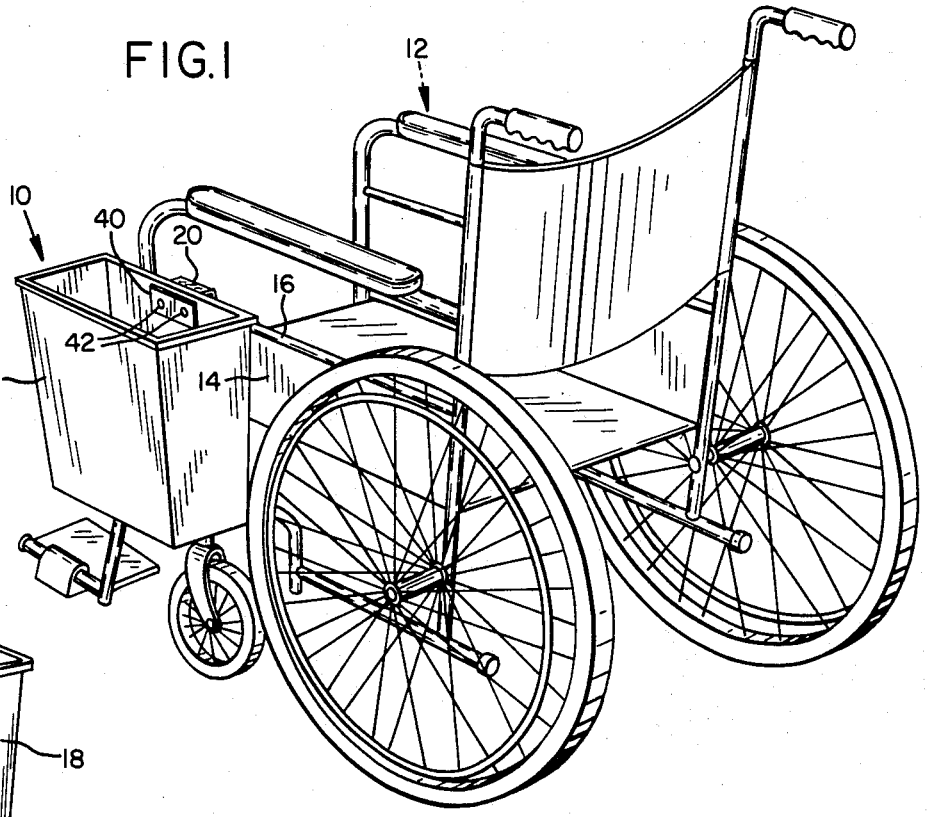
FIG. 2
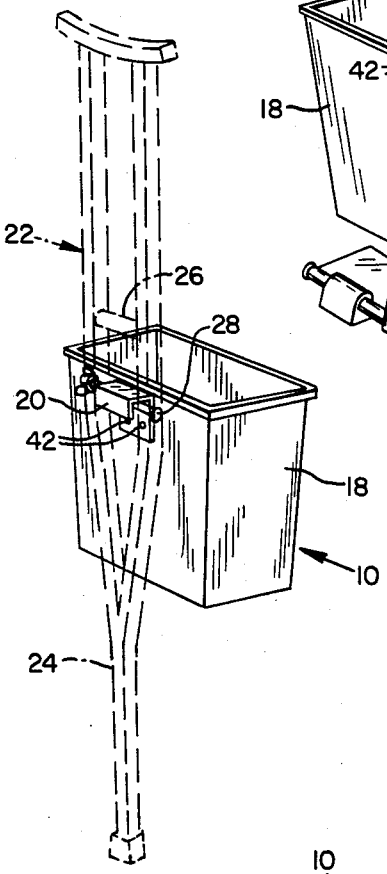
FIG. 3
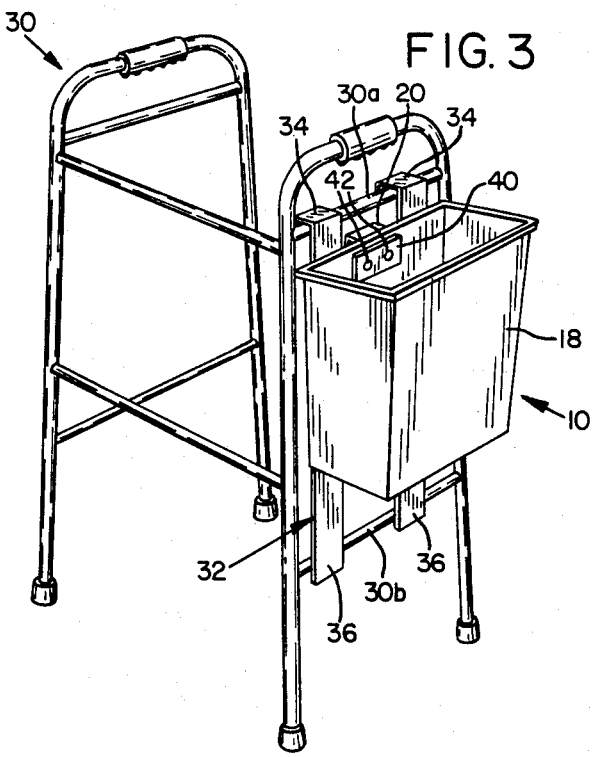
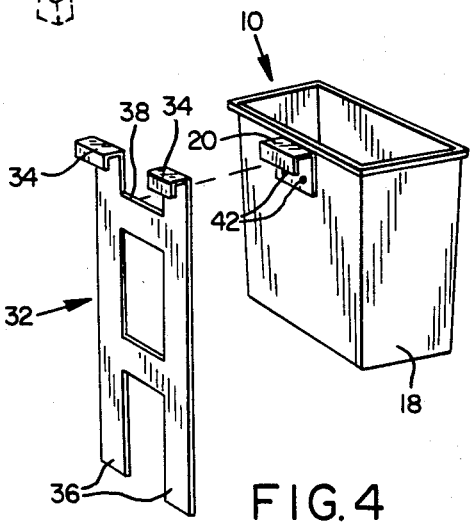
FIG. 4

ATTACHABLE BASKET FOR INVALID SUPPORT EQUIPMENT

BACKGROUND OF THE INVENTION

This invention relates to a receptacle for carrying articles and a monting therefor for attaching the receptacle to invalid support equipment such as wheelchairs, crutches and walkers for use by the handicapped.

Invalid support equipment generally does not make provision for the carrying of articles such as books, paper, pens and pencils, pocketbooks, tools and the like.

However, the prior art does disclose invalid support equipment such as crutches with built in receptacles, and add-on attachments for carrying articles. Generally, such attachments tend to make the apparatus bulky and get in the way of the user.

In the case of crutches, attachable baskets engage the handle of the crutch and pose an inconvenience and a danger of pinching the user's fingers.

For use with walkers, the prior art discloses a basket which hangs on the front of the walker. This is extremely unstable during the use of the walker, especially if the basket is loaded.

Accordingly, it is the general object of the present invention to provide an article carrying receptacle and a mounting therefor for releasably attaching the receptacle to various items of invalid support equipment.

Another object is to provide mounting means for attaching the receptacle to a wheelchair.

Another object is to provide a mounting for attaching the receptacle to a crutch.

Another object is to provide a mounting for attaching the receptacle to a walker.

Yet another object is to provide a simply constructed basket which may be interchanged from mounting to mountings as the user desires.

A further object is to keep the receptacle and the mounting therefor well away from the normal working surfaces of the invalid support equipment.

Yet another object is to provide increased stability in a piece of equipment carrying the present receptacle.

A still further object is to provide an article carrying receptacle and mounting therefor which are simple and inexpensive to produce.

These and other objects and advantages and the manner in which they are achieved will be made apparent in the following specification and claims.

SUMMARY OF THE INVENTION

In its basic concept, the present invention is a receptacle for mounting on an item of invalid support equipment for carrying articles as the user desires. Several mountings are provided, each configured specifically for mounting on an individual item of invalid support equipment, and each having a substantially horizontal top edge. A basket which is configured to carry articles mounts a hook means which is configured to overlap and engage the top edge of the mounting bracket. In this configuration, the basket may be moved from one item of invalid support equipment to another as the user desires.

BRIEF DESCRIPTION OF THE DRAWINGS

FIG. 1 is a top perspective view of a wheelchair shown mounting the article carrying attachment of the present invention.

FIG. 2 is a top persepctive view of a crutch mounting the article carrying receptacle of the present invention.

FIG. 3 is a top perspective view of a walker shown mounting the article carrying receptacle of the present invention.

FIG. 4 is a top perspective exploded view showing the mounting bracket and receptacle of FIG. 3.

DESCRIPTION OF THE PREFERRED EMBODIMENT

Referring now to FIG. 1, the article carrying receptacle of the present invention is illustrated generally at 10 mounted on a wheelchair 12. A bracket means is provided on the wheelchair in the form of vertical panel 14. The panel has a top edge 16. Receptacle 10 includes a basket 18, and a hook means 20 mounted on the basket. The hook is configured to overlap the top edge of vertical panel 16 and support the basket on the outside of the wheelchair, forwardly of the rear wheel and alongside the user.

FIG. 2 illustrates receptacle 10 mounted on a crutch which is designated gererally at 22. The crutch includes a bifurcated upstanding leg 24 and a handle 26 extending between the leg members dimensioned and at a location for easy grasp by the hand of the user. A bracket means is provided which includes a rod 28, which may be a bolt or the like, extending between the leg members at a point below the handle. Hook 20 overlaps the rod and thereby supports the basket at a point away from the hand of the user.

FIG. 3 illustrates the the article carrying receptacle 10 of the present invention mounted on a walker 30. Walker 30 includes two spaced apart horizontal side bars, including top side bar **30*a* and bottom side bar 30*b*. FIG. 4 illustrates the monting bracket and the receptacle for use with the walker. The bracket means includes an H-shaped member denoted generally at 32. It includes two top hooks 34 configured to overlap top bar 30*a*, and two legs 36 extending downwardly from the hooks and configured to abut bottom bar 30*b*. Between the hooks and slightly below the top edge thereof, the H-shaped member provides a horizontal top edge 38 configured to receive and support the hook means of the receptacle. It can be seen that basket 18 is supported by hook 20 substantially vertically on the outside of the walker. H-shaped mounting bracket 32** does not allow the bottom of the basket to rock inwardly. The placement of the basket at the side of the walker provides a much more stable mounting point than the front of the walker.

Now further considering the basket and hook, it can be seen that basket 18 is preferably of substantially deep configuration, and may be made out of plastic material. Hook 20 is secured to the basket by means of rivets 42 extending through the top edge thereof and through a backing plate 40.

The same basket is readily transferred from one item of invalid support equipment to another. Meanwhile, the bracket means may stay mounted with each individual item. The construction of the present device is purposely simple to provide easy and low-cost manufacture and to provide a readily usable product.

Having described my invention in its preferred embodiment, I claim:

1. An article carrying receptacle and mounting therefor releasably attachable to a walker having two vertically spaced-apart horizontal side bars, comprising:

(a) a basket configured to carry articles;

(b) hook means mounted on the basket; and (c) bracket means mounte on the walker away from the usual working surfaces thereof, and including a plate having a hook at the top thereof configured to overlap the upper of the side bars and a leg extending downwardly from the hook/abutting the lower of the side bars, and having a horizontal top edge thereon configured to receive and support the hook means, the hook means supporting the basket substantially vertically on the outside of the walker.

2. The apparatus of claim 1 wherein the basket means and basket are adopted to be mountd on either side of the walker.

3. The apparatus of claim 1 wherein the bracket means comprises an H-shaped member having two top hooks overlapping the upper of the side bars and having the horizontal top edge therebetween and below the upper of the side bars.

4. An article carrying receptable and mounting therefor releasably attachable to a walker which includes, as part of its frame, a substantially horizontal side bar, comprising:

(a) a receptacle configured to carry articles;

(b) hooking means mounted on the receptacle operable to support the receptacle; and (c) bracket means mounted on the walker away from the usual working surfaces thereof, and including a plate having a hook at the top thereof configured to overlap the horizontal bar, and a leg extending downwardly from the hook and abutting the frame of the walker below the bar, and having a horizontal top edge configured to receive and support the hooking means, to support the receptacle on the outside of the walker.

5. The apparatus of claim 4 wherein the bracket means and the receptacle are adopted to be mounted on either side of the walker.

6. The apparatus of claim 4 wherein the bracket means supports the receptacle below the hooking means to prevent the receptacle from swinging.

7. The apparatus of claim 4 wherein the bracket means includes two top hooks overlapping the bar and having the horizontal top edge therebetween and below the bar.

* * * * *

UNITED STATES PATENT AND TRADEMARK OFFICE

CERTIFICATE OF CORRECTION

PATENT NO. : 4,491,257

DATED : January 1, 1985

INVENTOR(S) : Wesley L. Ingles

It is certified that error appears in the above-identified patent and that said Letters Patent is hereby corrected as shown below:

Column 1, line 38, "mountings" should read -- mounting --. Column 2, line 35, after "FIG. 4" insert -- better --; line 35, "monting" should read -- mounting --. Claim 1, line 6, "mounte" should read -- mounted --; line 10, "hook/abutting" should read -- hook and abutting --. Claim 2, line 1, "basket" should read -- bracket --; line 2, "adopted" should read -- adapted --; line 2, "mountd" should read -- mounted --. Claim 4, line 1, "receptable" should read -- receptacle --. Claim 5, line 2, "adopted" should read -- adapted --.

Signed and Sealed this

*Twenty-third* Day of *April 1985*

[SEAL]

*Attest:*

DONALD J. QUIGG

*Attesting Officer*

*Acting Commissioner of Patents and Trademarks*